US010329645B2

(12) United States Patent
Daitoh

(10) Patent No.: US 10,329,645 B2
(45) Date of Patent: Jun. 25, 2019

(54) STEEL FOR CARBURIZING OR CARBONITRIDING USE

(75) Inventor: Yoshihiro Daitoh, Chiba (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 364 days.

(21) Appl. No.: 13/980,922

(22) PCT Filed: Jan. 23, 2012

(86) PCT No.: PCT/JP2012/051333

§ 371 (c)(1),
(2), (4) Date: Oct. 1, 2013

(87) PCT Pub. No.: WO2012/102233

PCT Pub. Date: Aug. 2, 2012

(65) Prior Publication Data

US 2014/0030137 A1 Jan. 30, 2014

(30) Foreign Application Priority Data

Jan. 25, 2011 (JP) ..... 2011-012580

(51) Int. Cl.

| | |
|---|---|
| ***C22C 38/18*** | (2006.01) |
| ***C22C 38/00*** | (2006.01) |
| ***C23C 8/22*** | (2006.01) |
| ***C23C 8/32*** | (2006.01) |

(Continued)

(52) U.S. Cl.

CPC ..... *C22C 38/18* (2013.01); *C22C 38/00* (2013.01); *C22C 38/001* (2013.01);
(Continued)

(58) Field of Classification Search

CPC ..... C22C 38/18; C22C 38/06; C22C 38/04; C22C 38/02; C22C 38/001; C22C 38/22; C22C 38/24; C22C 38/26; C22C 38/28

See application file for complete search history.

(56) References Cited

U.S. PATENT DOCUMENTS 6,425,963 B1 * 7/2002 Kaneko ..... C21D 8/0226 148/320
2011/0091348 A1 * 4/2011 Hatano et al. ..... 420/83

FOREIGN PATENT DOCUMENTS

JP 60-021359 2/1985
JP 56-075551 10/1989

(Continued)

*Primary Examiner* — Matthew E. Hoban
(74) *Attorney, Agent, or Firm* — Clark & Brody

(57) ABSTRACT

A steel for carburizing or carbonitriding use consisting of, by mass %, C: 0.1 to 0.3%, Si: 0.01 to 0.15%, Mn: 0.6 to 1.5%, S: 0.012 to 0.05%, Cr: 0.5 to 2.0%, Al: 0.030 to 0.050%, Ti: 0.0006 to 0.0025%, N: 0.010 to 0.025%, and O: 0.0006 to 0.0012%, and, optionally, at least one selected from Mo≤0.5%, Ni≤1.5% and Cu≤0.4%, and the balance of Fe and impurities. P and Nb are P≤0.025% and Nb≤0.003% respectively. Formulas of $[-5.0 \leq \log(Ti \times N) \leq -4.4]$ and $[-12.5 \leq \log(Al^2 \times O^3) \leq -11.7]$ are satisfied. Austenite grain coarsening is prevented even when the steel is heated in the process of carburizing or carbonitriding, and even under various hot forging temperatures. The steel has excellent bending fatigue strength after carburizing or carbonitriding.

4 Claims, 1 Drawing Sheet

(51) Int. Cl.

| | |
|---|---|
| ***C22C 38/02*** | (2006.01) |
| ***C22C 38/04*** | (2006.01) |
| ***C22C 38/06*** | (2006.01) |
| ***C22C 38/26*** | (2006.01) |
| ***C22C 38/28*** | (2006.01) |
| ***C22C 38/42*** | (2006.01) |
| ***C22C 38/44*** | (2006.01) |
| ***C22C 38/50*** | (2006.01) |
| *C21D 7/13* | (2006.01) |
| *C21D 9/32* | (2006.01) |
| *C21D 1/06* | (2006.01) |

(52) U.S. Cl.

CPC ..... *C22C 38/002* (2013.01); *C22C 38/02* (2013.01); *C22C 38/04* (2013.01); *C22C 38/06* (2013.01); *C22C 38/26* (2013.01); *C22C 38/28* (2013.01); *C22C 38/42* (2013.01); *C22C 38/44* (2013.01); *C22C 38/50* (2013.01); *C23C 8/22* (2013.01); *C23C 8/32* (2013.01); *C21D 1/06* (2013.01); *C21D 7/13* (2013.01); *C21D 9/32* (2013.01)

(56) References Cited

FOREIGN PATENT DOCUMENTS

| | | | | |
|---|---|---|---|---|
| JP | 2001-279383 | | 10/2001 | |
| JP | 2010-180455 | | 8/2010 | |
| JP | 2011-157597 | | 8/2011 | |
| JP | 2011-225897 | | 11/2011 | |
| WO | WO 2009154235 | A1 * | 12/2009 | ..... C22C 38/04 |

* cited by examiner

STEEL FOR CARBURIZING OR CARBONITRIDING USE

TECHNICAL FIELD

The present invention relates to a steel for carburizing or carbonitriding use. More particularly, the present invention relates to a steel that has an excellent property in preventing grain coarsening at the time of carburizing or carbonitriding, and in addition has an excellent bending fatigue strength after carburizing or carbonitriding, and is suitable as a steel for a starting material of parts, such as gears, pulleys, and shafts.

BACKGROUND ART

In many cases, parts such as gears, pulleys, and shafts for motor vehicles and industrial machinery are manufactured by roughly shaping them by hot forging or cold forging, by subjecting them to machining and thereafter to casehardening by carburizing quenching or carbonitriding quenching. However, at the said casehardening treatment, if austenite grains before quenching are coarsened, there easily arise problems that the fatigue strength as a part decreases and that the amount of distortion at the quenching time increases.

Generally, it has been thought that, as compared with cold forged parts, in hot forged parts, the austenite grains are less liable to be coarsened at the time of carburizing or carbonitriding.

In recent years, however, with the progress of hot forging technique, hot forging has frequently been carried out in various temperature ranges: and thus the number of hot forged parts with the austenite grains coarsened at the time of carburizing or carbonitriding has increased.

Therefore, there has been demanded a hot rolled steel bar or wire rod in which the austenite grain coarsening can be stably prevented at the heating time in the process of carburizing or carbonitriding even if hot forging is carried out in various temperature ranges, and techniques concerning steels and producing methods therefore have been proposed in the Patent Literatures 1 to 3.

To be concrete, the Patent Literature 1 discloses "a grain stabilized carburizing steel" characterized in that the steel with limited amounts of sol.Al and N and a limited ratio of "sol.Al/N" is heated to a temperature of 1200° C. or more and thereafter is hot worked.

The Patent Literature 2 discloses "a steel for high temperature carburizing having an excellent property in high temperature carburizing, and a hot forged member for high temperature carburizing" characterized in that the elements such as Al, Nb and N are contained in a specific amount respectively, and the precipitation amounts of Nb(C, N) and AlN after hot rolling are restricted, and moreover the microstructure after hot rolling is also restricted.

The Patent Literature 3 discloses "a steel for gears" in which Si: 0.1% or less and P: 0.01% or less and so on are regulated and which provides highly reliable gears having high strength and high toughness.

LIST OF PRIOR ART DOCUMENT

Patent Literatures

Patent Literature 1: JP 56-75551 A
Patent Literature 2: JP 2001-279383 A
Patent Literature 1: JP 60-21359 A

DISCLOSURE OF THE INVENTION

Problems to be Solved by the Invention

In the techniques disclosed in the aforementioned Patent Literatures 1 to 3, it could not necessarily be said that in the case where hot forging is carried out in various temperature ranges, the austenite grain coarsening can be stably prevented at the time of heating in the process of carburizing or carbonitriding.

In the technique proposed in the Patent Literature 1, the steel is heated to a temperature of 1200° C. or more, and thereafter is hot worked. However, in the hot forging in mass production, many parts are heated to a temperature less than 1200° C. Therefore, the said Patent Literature 1 does not propose a technique in which the austenite grain coarsening can be stably prevented at the time of carburizing or carbonitriding even in the case where hot forging is carried out in various temperature ranges.

In the technique proposed in the Patent Literature 2, precipitates except Nb(C, N) and AlN are not considered. Therefore, it cannot necessarily be said that in the case where hot forging is carried out in various temperature ranges, the austenite grain coarsening can be stably prevented at the time of heating process for carburizing or carbonitriding.

In the technique proposed in the Patent Literature 3, the austenite grain coarsening at the time of heating process for carburizing or carbonitriding is not considered. Therefore, it cannot necessarily be said that high bending strength can be stably ensured.

The present invention has been made in view of the aforementioned situation, and accordingly the objective thereof is to provide a steel for carburizing or carbonitriding use in which the said austenite grain coarsening can be stably prevented, when the steel is heated in the process of carburizing or carbonitriding, especially when the steel is heated at a temperature of 980° C. or less for three hours or less even if being hot forged in various temperature ranges, especially being hot forged after being heated to 1050 to 1300° C., and in addition an excellent bending fatigue strength after carburizing or carbonitriding can be ensured. The steel according to the present invention is suitable as a steel for a starting material of parts that are roughly formed by hot forging.

With regard to the present invention, in the case where two or more austenite grains having a grain size number of 4 or less exist in the field of 10 $mm^2$, it is judged that the austenite grains are coarsened.

Means for Solving the Problems

So far, it has been known that as disclosed in the Patent Literature 1 and the Patent Literature 2, by limiting the amounts of sol.Al and N and the ratio of "sol.Al/N", and the precipitation amounts of Nb(C, N) and AlN, the austenite grain coarsening can be prevented at the time of heating process for carburizing or carbonitriding.

However, with regard to the aforementioned techniques, it cannot necessarily be said that in the case where hot forging is carried out in various temperature ranges, the austenite grain coarsening can be stably prevented when the steel is heated for carburizing or carbonitriding at a temperature of 980° C. or less.

The present inventors made investigations and studies repeatedly into the influence of the chemical composition, especially the contents of Al, Ti and O, which are the elements being liable to form relatively coarse precipitates, on a steel in which the said austenite grain coarsening can be stably prevented even if the steel is heated at a temperature of 980° C. or less in the process of carburizing or carbonitriding in the case where hot forging is carried out in various temperature ranges.

As a result, the present inventors obtained the following findings (a) to (e).

In the description below, the said "carburizing or carbonitriding" is sometimes referred simply to as "carburizing". And in addition, unless otherwise noted, the "heating for carburizing" means "heating at a temperature of 980° C. or less for carburizing."

(a) With regard to steels for carburizing use, if once austenite grains become coarse, from the stage of a bloom to the stage before carburizing, the austenite grain coarsening is liable to occur at the time of carburizing. Therefore, even in the case where hot forging is carried out in various temperature ranges, in order to stably prevent the austenite grain coarsening at the time of carburizing, it is necessary to suppress the occurrence of austenite grain coarsening in all the stages from the stage of a bloom to the stage before carburizing.

(b) Among the production processes from the stage of a bloom to the stage of a carburized part, $Al_2O_3$ and TiN have an effect of preventing the austenite grain coarsening in the case where the heating temperature is 1200° C. or more. However, $Al_2O_3$ and TiN are liable to become coarse precipitates: and in the case where the amounts of the coarse precipitates become large, bending strength decreases.

(c) In order to control the amounts and sizes of the said $Al_2O_3$ and TiN precipitates, it is useful to estimate the contents of Al, O, Ti and N from the formulas based on the respective solubility products.

(d) In order to stably prevent the austenite grain coarsening at the time of carburizing even in the case where hot forging is carried out in various temperature ranges, it is necessary to increase the content of Al in addition to the above item (c).

(e) In order to increase the bending strength, it is effective to decrease the content of Si in addition to the prevention of the austenite grain coarsening at the time of carburizing.

The present invention has been accomplished on the basis of the above-described findings. The main points of the present invention are the steels for carburizing or carbonitriding use shown in the following (1) and (2).

(1) A steel for carburizing or carbonitriding use characterized in that the steel consists of, by mass %;

C: 0.1 to 0.3%,
Si: 0.01 to 0.15%,
Mn: 0.6 to 1.5%,
S: 0.012 to 0.05%,
Cr: 0.5 to 2.0%,
Al: 0.030 to 0.050%,
Ti: 0.0006 to 0.0025%,
N: 0.010 to 0.025%, and
O: 0.0006 to 0.0012%, and the balance of Fe and impurities, wherein P and Nb among the impurities are P: 0.025% or less and Nb: 0.003% or less respectively, and further the following formulas (1) and (2) are satisfied:

$$-5.0 \leq \log(T \times N) \leq -4.4 \quad (1),$$

$$-12.5 \leq \log(Al^2 \times O^3) \leq -11.7 \quad (2),$$

wherein each element symbol in the above formulas (1) and (2) represents the content by mass percent of the element concerned.

(2) The steel for carburizing or carbonitriding use according to the above (1), which contains, by mass percent, at least one element selected from the elements shown below in lieu of a part of Fe:

Mo: 0.5% or less,
Ni: 1.5% or less, and
Cu: 0.4% or less.

The term "impurities" so referred to in the phrase "the balance of Fe and impurities" indicates those elements which come from the raw materials such as ore and scrap, and/or the production environment when the steel is produced on an industrial scale.

Advantageous Effects of the Invention

The steel for carburizing or carbonitriding use in accordance with the present invention can stably prevent the austenite grain coarsening, when the said steel is heated in the process of carburizing or carbonitriding, especially when the steel is heated at a temperature of 980° C. or less for three hours or less even if being hot forged in various temperature ranges, especially being hot forged after being heated to 1050 to 1300° C., and in addition can ensure an excellent bending fatigue strength after carburizing or carbonitriding. Therefore, the steel according to the present invention can be suitably used as a steel for a starting material of parts, such as gears, pulleys, and shafts, that are roughly formed by hot forging.

BRIEF DESCRIPTION OF THE DRAWINGS

FIG. 2 represents carbon potential.

MODE FOR CARRYING OUT THE INVENTION

Figure 1:
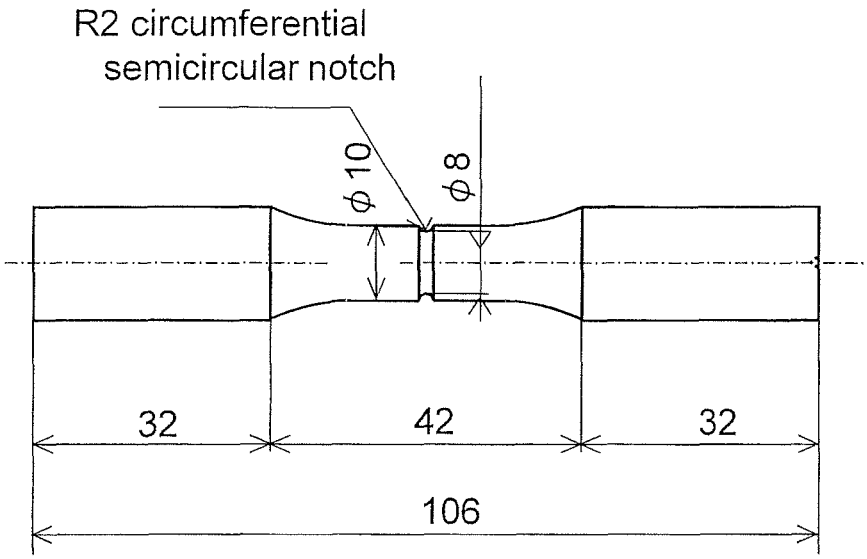
FIG. 1 is a view showing a shape of a notched Ono type rotating bending fatigue test piece used in the EXAMPLES. In this figure, the units of the dimensions are "mm".

In the following, all of the requirements of the present invention are described in detail. In the following description, the symbol "%" for the content of each element means "% by mass".

C: 0.1 to 0.3%

C (carbon) is an essential element for ensuring the core strength of a part subjected to carburizing quenching or carbonitriding quenching, and thus obtaining the target bending fatigue strength. In the case where the content of C is less than 0.1%, it is insufficient to achieve the said effect. On the other hand, if the content of C exceeds 0.3%, the amount of distortion of the part subjected to carburizing quenching or carbonitriding quenching increases remarkably. Therefore, the content of C is set to 0.1 to 0.3%. The content of C is preferably 0.18% or more, and preferably 0.23% or less.

Si: 0.01 to 0.15%

Si (silicon) is an element having an effect of enhancing the hardenability. However, if the content of Si is less than 0.01%, the above effect is insufficient. On the other hand, Si increases the intergranularly oxidized layers at the time of carburizing treatment or carbonitriding treatment. In particular, if the content of Si exceeds 0.15%, the said intergranularly oxidized layers increase remarkably and the bending fatigue strength deteriorates; and thus the bending fatigue strength cannot meet the target of the present invention mentioned later. Therefore, the content of Si is set to 0.01 to 0.15%. The content of Si is preferably 0.05% or more, and preferably 0.10% or less.

Mn: 0.6 to 1.5%

Mn (manganese) has a great effect of enhancing the hardenability and is an essential element for ensuring the core strength at the time of carburizing quenching or carbonitriding quenching, and thus for obtaining the target bending fatigue strength. In the case where the content of Mn is less than 0.6%, the above effect is insufficient. If the content of Mn exceeds 1.5%, the said effect is saturated; and thus the cost increases. Therefore, the content of Mn is set to 0.6 to 1.5%. The content of Mn is preferably 1.1% or less, and more preferably 0.9% or less.

S: 0.012 to 0.05%

S (sulfur) is an element which combines with Mn to form MnS, and improves the machinability. The said MnS has an effect of preventing the austenite grain coarsening in the case where the heating is carried out at high temperatures. However, if the content of S is less than 0.012%, the above effects are insufficient. On the other hand, if the content of S increases, coarse MnS is liable to be formed, and it tends to degrade the bending fatigue strength. In particular, if the content of S exceeds 0.05%, the bending fatigue strength degrades remarkably. Therefore, the content of S is set to 0.012 to 0.05%. The content of S is preferably 0.02% or less.

Cr: 0.5 to 2.0%

Cr (chromium) is an effective element for improving the bending fatigue strength because of having an effect of enhancing the hardenability. In the case where the content of Cr is less than 0.5%, the target bending fatigue strength cannot be obtained. If the content of Cr exceeds 2.0%, the said effect is saturated; and thus the cost increases. Therefore, the content of Cr is set to 0.5 to 2.0%. The content of Cr is preferably 0.9% or more, and preferably 1.3% or less.

Al: 0.030 to 0.050%

Al (aluminum) has a deoxidizing action. In addition, Al is liable to form AlN by combining with N; and thus Al is an effective element for preventing the austenite grain coarsening at the time of heating for carburizing. If the content of Al is less than 0.030%, it is impossible to prevent the austenite grain coarsening stably. In the case where austenite grains are coarsened, the bending fatigue strength deteriorates. On the other hand, if the content of Al exceeds 0.050%, coarse oxides are liable to be formed, and it tends to degrade the bending fatigue strength. Therefore, the content of Al is set to 0.030 to 0.050%. The content of Al is preferably 0.045% or less, and more preferably 0.040% or less.

Ti: 0.0006 to 0.0025%

Ti (titanium) is liable to form hard and coarse TiN by combining with N. However, Ti is an effective element for preventing the austenite grain coarsening in the case where the heating is carried out at high temperatures. If the content of Ti is less than 0.0006%, it is impossible to prevent the austenite grain coarsening stably. In the case where austenite grains are coarsened, the bending fatigue strength deteriorates. On the other hand, if the content of Ti exceeds 0.0025%, the bending fatigue strength deteriorates remarkably. Therefore, the content of Ti is set to 0.0006 to 0.0025%. The content of Ti is preferably 0.0008% or more, and more preferably 0.0010% or more. In addition, the content of Ti is preferably 0.0020% or less.

N: 0.010 to 0.025%

N (nitrogen) is liable to form TiN and AlN by combining with Ti and Al; and thus N is an effective element for preventing the austenite grain coarsening at the time of heating for carburizing. If the content of N is less than 0.010%, it is impossible to prevent the austenite grain coarsening stably. On the other hand, if the content of N exceeds 0.025%, in the steel making process, stable mass production becomes difficult to achieve. Therefore, the content of N is set to 0.010 to 0.025%. The content of N is preferably 0.014% or more, and preferably 0.020% or less.

O: 0.0006 to 0.0012%

O (oxygen) is liable to form hard and coarse $Al_2O_3$ by combining with Al. However, O is an effective element for preventing the austenite grain coarsening in the case where the heating is carried out at high temperatures. If the content of O is less than 0.0006%, it is impossible to prevent the austenite grain coarsening stably. In the case where austenite grains are coarsened, the bending fatigue strength deteriorates. On the other hand, if the content of O exceeds 0.0012%, the bending fatigue strength deteriorates remarkably. Therefore, the content of O is set to 0.0006 to 0.0012%. The content of O is preferably 0.0009% or less.

log(Ti×N): −5.0 to −4.4

The said TiN is effective in preventing the austenite grain coarsening in the case where the heating is carried out at high temperatures. If the log(Ti×N) is less than −5.0, even if the contents of Ti and N are in the aforementioned ranges, it is impossible to prevent the austenite grain coarsening stably. In the case where austenite grains are coarsened, the bending fatigue strength deteriorates. On the other hand, if the log(Ti×N) exceeds −4.4, the bending fatigue strength deteriorates remarkably.

Therefore, it is necessary to satisfy the formula (1), that is to say, the formula of $[-5.0 \leq \log(Ti \times N) \leq -4.4]$.

The log(Ti×N) is preferably −4.9 or more, and preferably −4.6 or less.

$\log(Al^2 \times O^3)$: −12.5 to −11.7

The said $Al_2O_3$ is effective in preventing the austenite grain coarsening in the case where the heating is carried out at high temperatures. If the $\log(Al^2 \times O^3)$ is less than −12.5, even if the contents of Al and O are in the aforementioned ranges, it is impossible to prevent the austenite grain coarsening stably. In the case where austenite grains are coarsened, the bending fatigue strength deteriorates. On the other hand, if the $\log(Al^2 \times O^3)$ exceeds −11.7, the bending fatigue strength deteriorates remarkably.

Therefore, it is necessary to satisfy the formula (2), that is to say, the formula of $[-12.5 \leq \log(Al^2 \times O^3) \leq -11.7]$.

The $\log((Al^2 \times O^3)$ is preferably −12.4 or more, and preferably −12.0 or less.

One of the steels for carburizing or carbonitriding use of the present invention consists of the elements mentioned above, and the balance of Fe and impurities, wherein P and Nb among the impurities are P: 0.025% or less and Nb: 0.003% or less respectively.

Hereunder, P and Nb among the impurities are explained.

P: 0.025% or Less

P (phosphorus) is an element that segregates at grain boundaries and is liable to make the grain boundaries brittle. If the content of P exceeds 0.025%, the bending fatigue strength deteriorates. Therefore, the content of P among the impurities is set to 0.025% or less. The content of P among the impurities is preferably set to 0.020% or less.

Nb: 0.003% or Less

Nb (niobium) is an element being liable to form Nb(C, N) by combining with C and N. The said Nb(C, N) is sometimes effective in preventing the austenite grain coarsening at the time of carburizing. However, at various heating temperatures for hot forging, it rather sometimes promotes austenite grain coarsening at the time of carburizing, and in the case where the content of Nb exceeds 0.003%, the said coarsening is liable to occur. Therefore, the content of Nb among the impurities is set to 0.003% or less. The content of Nb among the impurities is preferably set to 0.001% or less.

Another of the steels for carburizing or carbonitriding use of the present invention contains at least one element selected from Mo, Ni and Cu in lieu of a part of Fe.

Hereunder, the effects of containing Mo, Ni and Cu, which are optional elements, and the reasons for the restriction of content thereof are explained.

Mo: 0.5% or Less

Mo (molybdenum) has a great effect of enhancing the hardenability and is an effective element for increasing the bending fatigue strength, so that Mo can be contained according to need. However, if the content of Mo exceeds 0.5%, the said effect is saturated; and thus the cost increases. Therefore, if Mo is contained, the content of Mo is set to 0.5% or less. When Mo is contained, the content of Mo is preferably 0.4% or less.

In the case where Mo is contained, in order to stably achieve the above effect of increasing the bending fatigue strength due to the improvement in hardenability of Mo, the content of Mo is preferably 0.02% or more, and more preferably 0.05% or more.

Ni: 1.5% or Less

Ni (nickel) has an effect of enhancing the hardenability and is an effective element for increasing the bending fatigue strength, so that Ni can be contained according to need. However, if the content of Ni exceeds 1.5%, the said effect is saturated; and thus the cost increases. Therefore, if Ni is contained, the content of Ni is set to 1.5% or less. When Ni is contained, the content of Ni is preferably 0.8% or less.

In the case where Ni is contained, in order to stably achieve the above effect of increasing the bending fatigue strength due to the improvement in hardenability of Ni, the content of Ni is preferably 0.1% or more, and more preferably 0.2% or more.

Cu: 0.4% or Less

Cu (copper) has an effect of enhancing the hardenability and is an effective element for increasing the bending fatigue strength, so that Cu can be contained according to need. However, if the content of Cu exceeds 0.4%, hot ductility decreases, and thus hot workability deteriorates remarkably. Therefore, if Cu is contained, the content of Cu is set to 0.4% or less. When Cu is contained, the content of Cu is preferably 0.3% or less.

In the case where Cu is contained, in order to stably achieve the above effect of increasing the bending fatigue strength due to the improvement in hardenability of Cu, the content of Cu is preferably 0.1% or more, and more preferably 0.2% or more.

With regard to the aforementioned Mo, Ni and Cu, only one or a combination of two or more elements can be contained. The total amount of these elements can be 2.4% or less; however the said total amount is preferably 1.0% or less.

In case of mass production on an industrial scale, in order to reduce the content of O, and in addition to regulate it within the desired ranges, for example, in the stage of a secondary refining of steelmaking process, it is recommended to use a LF (Ladle Furnace) equipment and an RH (Ruhrstahl-Heraeus) equipment and in addition to condition the respective treating time in the said each equipment.

In the following, the present invention is explained in detail by referring to examples.

EXAMPLES

The Steels a to z and Steels A to I having the chemical composition shown in Table 1 and Table 2 were melted by using a vacuum melting furnace and cast to 150 kg ingots respectively.

The Steel b, Steel c, Steel f, Steel i, Steel j, Steel m, Steels o to s, Steel v, Steel y, Steels A to F, Steel H and Steel I in Table 1 and Table 2 are steels having the chemical composition being within the range regulated by the present invention.

The Steel a, Steel d, Steel e, Steel g, Steel h, Steel k, Steel l, Steel n, Steel t, Steel u, Steel w, Steel x, Steel z and Steel G are steels of comparative examples having the chemical composition being out of the condition regulated by the present invention.

The Steel a is a steel corresponding to the SCr420H specified in JIS G 4052 (2008).

TABLE 1

| | Chemical composition (% by mass) Balance: Fe and impurities | | | | | | | | | | | | | | | |
|---|---|---|---|---|---|---|---|---|---|---|---|---|---|---|---|---|
| Steel | C | Si | Mn | P | S | Cr | Cu | Ni | Mo | Al | Nb | Ti | N | O | log(Ti × N) | log($Al^2 \times O^3$) |
| a | 0.20 | *0.25 | 0.78 | 0.014 | 0.018 | 1.03 | — | — | — | 0.031 | 0.001 | 0.0023 | 0.0118 | *0.0014 | −4.6 | *−11.6 |
| b | 0.21 | 0.05 | 0.85 | 0.012 | 0.016 | 1.13 | — | — | — | 0.036 | <0.001 | 0.0012 | 0.0174 | 0.0009 | −4.7 | −12.0 |
| c | 0.21 | 0.14 | 0.86 | 0.011 | 0.014 | 1.17 | — | — | — | 0.035 | 0.001 | 0.0009 | 0.0185 | 0.0011 | −4.8 | −11.8 |
| d | 0.21 | *0.18 | 0.83 | 0.013 | 0.017 | 1.14 | — | — | — | 0.033 | 0.001 | 0.0014 | 0.0153 | 0.0010 | −4.7 | −12.0 |
| e | 0.20 | 0.09 | 0.85 | 0.012 | 0.016 | 1.15 | — | — | — | *0.028 | <0.001 | 0.0011 | 0.0159 | 0.0008 | −4.8 | −12.4 |
| f | 0.21 | 0.08 | 0.84 | 0.013 | 0.018 | 1.12 | — | — | — | 0.048 | 0.001 | 0.0009 | 0.0194 | 0.0007 | −4.8 | −12.1 |
| g | 0.21 | 0.10 | 0.84 | 0.011 | 0.014 | 1.13 | — | — | — | *0.054 | <0.001 | 0.0012 | 0.0171 | 0.0007 | −4.7 | −12.0 |
| h | 0.21 | 0.09 | 0.87 | 0.013 | 0.016 | 1.14 | — | — | — | 0.043 | 0.001 | 0.0013 | 0.0187 | 0.0011 | −4.6 | *−11.6 |
| i | 0.22 | 0.09 | 0.86 | 0.014 | 0.016 | 1.13 | — | — | — | 0.045 | <0.001 | 0.0011 | 0.0178 | 0.0010 | −4.7 | −11.7 |
| j | 0.21 | 0.08 | 0.85 | 0.016 | 0.019 | 1.15 | — | — | — | 0.031 | <0.001 | 0.0008 | 0.0160 | 0.0007 | −4.9 | −12.5 |
| k | 0.21 | 0.10 | 0.85 | 0.011 | 0.015 | 1.12 | — | — | — | 0.032 | <0.001 | 0.0010 | 0.0152 | 0.0006 | −4.8 | *−12.7 |
| l | 0.21 | 0.09 | 0.87 | 0.013 | 0.014 | 1.14 | — | — | — | 0.049 | 0.001 | 0.0013 | 0.0163 | *0.0005 | −4.7 | −12.5 |
| m | 0.22 | 0.10 | 0.83 | 0.015 | 0.016 | 1.15 | — | — | — | 0.049 | 0.001 | 0.0011 | 0.0184 | 0.0007 | −4.7 | −12.1 |
| n | 0.21 | 0.09 | 0.83 | 0.011 | 0.015 | 1.10 | — | — | — | 0.030 | 0.001 | 0.0012 | 0.0156 | *0.0013 | −4.7 | −11.7 |
| o | 0.21 | 0.07 | 1.01 | 0.016 | 0.021 | 1.18 | — | — | — | 0.035 | <0.001 | 0.0008 | 0.0143 | 0.0012 | −4.9 | −11.7 |
| p | 0.22 | 0.08 | 1.02 | 0.014 | 0.013 | 1.17 | — | — | — | 0.045 | <0.001 | 0.0010 | 0.0139 | 0.0006 | −4.9 | −12.4 |
| q | 0.21 | 0.08 | 1.03 | 0.013 | 0.014 | 1.14 | — | — | — | 0.035 | 0.001 | 0.0006 | 0.0202 | 0.0008 | −4.9 | −12.2 |

The mark * denotes falling outside the conditions of chemical composition regulated by the present invention.

TABLE 2

| Steel | Chemical composition (% by mass) Balance: Fe and impurities | | | | | | | | | | | | | | | |
|---|---|---|---|---|---|---|---|---|---|---|---|---|---|---|---|---|
| | C | Si | Mn | P | S | Cr | Cu | Ni | Mo | Al | Nb | Ti | N | O | log(Ti × N) | log($Al^2$ × $O^3$) |
| r | 0.21 | 0.09 | 0.89 | 0.016 | 0.016 | 1.15 | — | — | — | 0.038 | <0.001 | 0.0007 | 0.0159 | 0.0008 | −5.0 | −12.1 |
| s | 0.21 | 0.10 | 0.86 | 0.015 | 0.017 | 1.14 | — | — | — | 0.034 | <0.001 | 0.0021 | 0.0169 | 0.0010 | −4.4 | −11.9 |
| t | 0.21 | 0.08 | 0.87 | 0.013 | 0.019 | 1.16 | — | — | — | 0.038 | 0.001 | *0.0005 | 0.0202 | 0.0008 | −5.0 | −12.1 |
| u | 0.20 | 0.09 | 0.86 | 0.014 | 0.015 | 1.14 | — | — | — | 0.034 | <0.001 | 0.0006 | 0.0132 | 0.0008 | *−5.1 | −12.2 |
| v | 0.22 | 0.09 | 0.86 | 0.015 | 0.018 | 1.21 | — | — | — | 0.036 | <0.001 | 0.0025 | 0.0164 | 0.0010 | −4.4 | −11.9 |
| w | 0.21 | 0.10 | 0.85 | 0.014 | 0.018 | 1.15 | — | — | — | 0.037 | <0.001 | *0.0027 | 0.0165 | 0.0009 | −4.4 | −12.0 |
| x | 0.21 | 0.08 | 0.87 | 0.015 | 0.016 | 1.14 | — | — | — | 0.035 | 0.001 | 0.0022 | 0.0212 | 0.0009 | *−4.3 | −12.0 |
| y | 0.21 | 0.07 | 0.84 | 0.013 | 0.015 | 1.20 | — | — | — | 0.038 | <0.001 | 0.0012 | 0.0224 | 0.0008 | −4.6 | −12.1 |
| z | 0.21 | 0.08 | 0.86 | 0.011 | *0.011 | 1.16 | — | — | — | 0.031 | <0.001 | 0.0008 | 0.0172 | 0.0008 | −4.9 | −12.3 |
| A | 0.22 | 0.08 | 0.78 | 0.014 | 0.018 | 1.15 | — | — | 0.18 | 0.034 | 0.001 | 0.0008 | 0.0164 | 0.0008 | −4.9 | −12.2 |
| B | 0.21 | 0.09 | 0.79 | 0.015 | 0.016 | 1.01 | — | — | 0.37 | 0.037 | <0.001 | 0.0009 | 0.0157 | 0.0007 | −4.8 | −12.3 |
| C | 0.21 | 0.08 | 0.81 | 0.013 | 0.016 | 0.99 | — | — | 0.42 | 0.036 | 0.001 | 0.0013 | 0.0191 | 0.0008 | −4.6 | −12.2 |
| D | 0.22 | 0.07 | 0.89 | 0.015 | 0.018 | 1.12 | — | 0.64 | — | 0.035 | <0.001 | 0.0011 | 0.0188 | 0.0009 | −4.7 | −12.0 |
| E | 0.21 | 0.06 | 0.62 | 0.016 | 0.019 | 0.63 | — | 0.49 | 0.38 | 0.039 | <0.001 | 0.0010 | 0.0179 | 0.0007 | −4.7 | −12.3 |
| F | 0.22 | 0.08 | 0.84 | 0.012 | 0.017 | 1.22 | — | — | — | 0.037 | 0.003 | 0.0012 | 0.0175 | 0.0010 | −4.7 | −11.9 |
| G | 0.21 | 0.08 | 0.83 | 0.013 | 0.018 | 1.18 | — | — | — | 0.039 | *0.005 | 0.0011 | 0.0186 | 0.0009 | −4.7 | −12.0 |
| H | 0.21 | 0.05 | 0.84 | 0.014 | 0.016 | 1.11 | 0.33 | 0.53 | — | 0.033 | <0.001 | 0.0009 | 0.0181 | 0.0008 | −4.8 | −12.3 |
| I | 0.20 | 0.07 | 0.87 | 0.013 | 0.014 | 1.42 | 0.15 | — | — | 0.037 | <0.001 | 0.0011 | 0.0174 | 0.0007 | −4.7 | −12.3 |

The mark * denotes falling outside the conditions of chemical composition regulated by the present invention.

The above each ingot was heated at 1250° C. for 4 hours, and thereafter was forged to prepare a steel bar having a diameter of 50 mm at a finishing temperature of 950° C. or more.

Four test pieces having a length of 90 mm were cut out from the said each steel bar having a diameter of 50 mm. Subsequently, in order to simulate hot forging, the four test pieces were heated at respective temperatures of 1300° C., 1200° C., 1100° C., and 1050° C. for one hour. Thereafter, after 15 seconds from when the each test piece was taken out from the furnace, the said test piece was compressed by 70% in the height direction of the cylindrical shape, and subsequently was stood to cool in the atmosphere, and thus cooled to room temperature.

The thus obtained test pieces were further heated at 930° C. for one hour, and then were stood to cool in the atmosphere, and thus cooled to room temperature.

Next, in order to simulate heating for carburizing, the thus obtained each test piece was cut into four equal pieces in the longitudinal cross sectional direction, and the divided test pieces were respectively held at temperatures of 950° C., 980° C., 1010° C., and 1040° C. for three hours, and thereafter were cooled to room temperature by water cooling.

The cut plane of the thus obtained each test piece was removed by a thickness of 1 mm, and the said cut plane was mirror-like polished and was etched with a picric acid saturated aqueous solution to which a surface-active agent was added. Subsequently, with regard to the above each etched plane, randomly selected ten visual fields were observed by using an optical microscope at a magnification of 100 times to examine the state of the occurrence of austenite grain coarsening.

The size of each visual field in the above examination was set to 1.0 mm×1.0 mm. In the case where it was found by this examination that two or more austenite grains having a grain size number of 4 or less, specified in JIS G 0551 (2005), did exist in the field of 10 $mm^2$, it was judged that the austenite grains were coarsened.

The target of the effect of preventing the austenite grain coarsening was made such that austenite grains are not coarsened when the test piece is heated at a temperature of 980° C. or lower for three hours in the above simulation of heating for carburizing.

Tables 3 and 4 show the above investigation results of the state of the occurrence of austenite grain coarsening together with the temperature at which the test piece was heated to simulate hot forging.

TABLE 3

| Steel | Heating temperature at forging (° C.) | Austenite grain coarsening temperature (° C.) |
|---|---|---|
| * a | 1300 | 1010 |
| | 1200 | 1040 |
| | 1100 | 1010 |
| | 1050 | # 980 |
| b | 1300 | 1040 |
| | 1200 | >1040 |
| | 1100 | 1040 |
| | 1050 | 1010 |
| c | 1300 | 1040 |
| | 1200 | 1040 |
| | 1100 | 1010 |
| | 1050 | 1010 |
| * d | 1300 | 1040 |
| | 1200 | 1040 |
| | 1100 | 1010 |
| | 1050 | 1010 |
| * e | 1300 | 1010 |
| | 1200 | 1010 |
| | 1100 | # 950 |
| | 1050 | # 950 |
| f | 1300 | >1040 |
| | 1200 | 1040 |
| | 1100 | 1010 |
| | 1050 | 1010 |
| * g | 1300 | 1040 |
| | 1200 | 1010 |
| | 1100 | # 980 |
| | 1050 | # 950 |
| * h | 1300 | >1040 |
| | 1200 | 1040 |
| | 1100 | 1010 |
| | 1050 | 1010 |
| i | 1300 | >1040 |
| | 1200 | 1040 |
| | 1100 | 1010 |
| | 1050 | 1010 |
| j | 1300 | 1010 |
| | 1200 | 1040 |
| | 1100 | 1010 |
| | 1050 | 1010 |

TABLE 3-continued

| Steel | Heating temperature at forging (° C.) | Austenite grain coarsening temperature (° C.) |
|---|---|---|
| * k | 1300 | # 950 |
| | 1200 | 1010 |
| | 1100 | 1010 |
| | 1050 | 1010 |
| * l | 1300 | # 950 |
| | 1200 | 1010 |
| | 1100 | 1010 |
| | 1050 | 1010 |
| m | 1300 | >1040 |
| | 1200 | 1040 |
| | 1100 | 1010 |
| | 1050 | 1010 |
| * n | 1300 | 1010 |
| | 1200 | 1040 |
| | 1100 | 1010 |
| | 1050 | 1010 |
| o | 1300 | 1010 |
| | 1200 | 1040 |
| | 1100 | 1010 |
| | 1050 | 1010 |
| p | 1300 | 1040 |
| | 1200 | 1040 |
| | 1100 | 1010 |
| | 1050 | 1010 |
| q | 1300 | 1040 |
| | 1200 | 1040 |
| | 1100 | 1010 |
| | 1050 | 1010 |
| r | 1300 | 1040 |
| | 1200 | 1040 |
| | 1100 | 1010 |
| | 1050 | 1010 |

The mark * denotes that the steel is falling outside the conditions regulated by the present invention.
The mark # denotes falling short of the target in the present invention.

TABLE 4

| Steel | Heating temperature at forging (° C.) | Austenite grain coarsening temperature (° C.) |
|---|---|---|
| s | 1300 | 1010 |
| | 1200 | 1040 |
| | 1100 | 1010 |
| | 1050 | 1010 |
| * t | 1300 | # 980 |
| | 1200 | 1010 |
| | 1100 | 1010 |
| | 1050 | 1010 |
| * u | 1300 | # 950 |
| | 1200 | # 980 |
| | 1100 | 1010 |
| | 1050 | 1010 |
| v | 1300 | 1010 |
| | 1200 | 1040 |
| | 1100 | 1010 |
| | 1050 | 1010 |
| * w | 1300 | 1010 |
| | 1200 | 1040 |
| | 1100 | 1010 |
| | 1050 | 1010 |
| * x | 1300 | 1010 |
| | 1200 | 1040 |
| | 1100 | 1010 |
| | 1050 | 1010 |
| y | 1300 | >1040 |
| | 1200 | 1040 |
| | 1100 | 1010 |
| | 1050 | 1010 |
| * z | 1300 | # 950 |
| | 1200 | 1010 |

TABLE 4-continued

| Steel | Heating temperature at forging (° C.) | Austenite grain coarsening temperature (° C.) |
|---|---|---|
| | 1100 | 1010 |
| | 1050 | # 980 |
| A | 1300 | 1040 |
| | 1200 | >1040 |
| | 1100 | 1040 |
| | 1050 | 1010 |
| B | 1300 | 1040 |
| | 1200 | >1040 |
| | 1100 | 1040 |
| | 1050 | 1010 |
| C | 1300 | 1040 |
| | 1200 | >1040 |
| | 1100 | 1040 |
| | 1050 | 1010 |
| D | 1300 | 1040 |
| | 1200 | >1040 |
| | 1100 | 1040 |
| | 1050 | 1010 |
| E | 1300 | 1040 |
| | 1200 | >1040 |
| | 1100 | 1040 |
| | 1050 | 1010 |
| F | 1300 | 1040 |
| | 1200 | >1040 |
| | 1100 | 1010 |
| | 1050 | 1010 |
| * G | 1300 | 1040 |
| | 1200 | >1040 |
| | 1100 | # 980 |
| | 1050 | # 950 |
| H | 1300 | 1040 |
| | 1200 | >1040 |
| | 1100 | 1010 |
| | 1050 | 1010 |
| I | 1300 | 1040 |
| | 1200 | >1040 |
| | 1100 | 1010 |
| | 1050 | 1010 |

The mark * denotes that the steel is falling outside the conditions regulated by the present invention.
The mark # denotes falling short of the target in the present invention.

In addition, with regard to each steel, on the basis of the investigation results of the occurrence of austenite grain coarsening, the steel bar thereof having a diameter of 50 mm was heated at one of temperatures shown in the following <1> to <3> (to be concrete, the temperature described in the column of "Heating temp." in Table 5, mentioned later) for 0.75 hours, and was then hot forged at a finishing temperature of 950° C. or more into steel bar having a diameter of 30 mm, and thereafter the obtained steel bar was stood to cool in the atmosphere, and thus cooled to room temperature.

<1> In Tables 3 and 4, in the case of the steels that could achieve the aforementioned target of the effect of preventing the austenite grain coarsening (that is to say, the steels having no description of 980° C. and 950° C. that were a temperature of 980° C. or less in the column of "Austenite grain coarsening temperature"): 1200° C.

<2> In Tables 3 and 4, in the case of the steels having one of the descriptions of 980° C. and 950° C. in the column of "Austenite grain coarsening temperature": the "Heating temperature at forging" in the case of the "Austenite grain coarsening temperature" of either 980° C. or 950° C. Incidentally, if there are two "Heating temperatures at forging" corresponding to the above condition, the lower temperature of them.

<3> In Tables 3 and 4, in the case of the steels having both of the descriptions 980° C. and 950° C. in the column of "Austenite grain coarsening temperature": the "Heating temperature at forging" in the case of the "Austenite grain coarsening temperature" of 950° C.

The each steel bar having a diameter of 30 mm obtained in the above described manner was further heated at a temperature of 930° C. for one hour, and thereafter was stood to cool in the atmosphere, and thus cooled to room temperature.

Notched Ono type rotating bending fatigue test pieces having the shape shown in FIG. 1 were produced from the central portion of the said each steel bar having a diameter of 30 mm by machining. In FIG. 1, the units of the dimensions are "mm".

Figure 2:
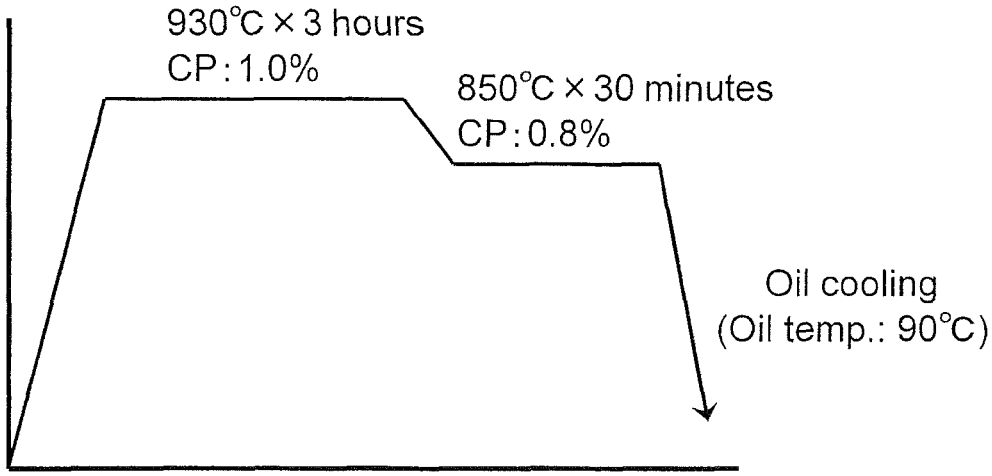
FIG. 2 is a diagram showing the heat pattern of "carburizing quenching" carried out on the test piece shown in FIG. 1 in the EXAMPLES. The "CP" in this

By using a gas carburizing furnace, the above test pieces were subjected to carburizing quenching under the condition shown in FIG. 2. Thereafter, they were tempered at 170° C. for 1.5 hours. The "CP" in FIG. 2 represents carbon potential.

For the purpose of removing heat treating distortion from each test piece, both grip portions of each test piece were finished to have a diameter of 15 mm. Thereafter, the Ono type rotating bending fatigue test was carried out at room temperature by using the said finished test pieces.

The Ono type rotating bending fatigue test at room temperature was carried out in accordance with a common test method except for the following conditions: number of used test piece: eight, and number of revolutions: 3000 rpm. The maximum stresses where the test pieces did not rupture in the number of cycles of $10\times10^4$, and of $10\times10^7$ were defined as the "Medium cycle rotating bending fatigue strength", and as the "High cycle rotating bending fatigue strength", respectively.

The target value of the said rotating bending fatigue strength was defined to be 10% or more than the references of "100", that is to say, to be 110 or more, where the said references were defined by using the "Medium cycle rotating bending fatigue strength" and the "High cycle rotating bending fatigue strength" after carburizing quenching-tempering treatment of the said Steel a corresponding to the SCr420H being common as a versatile steel.

The investigation results of the aforementioned Ono type rotating bending fatigue test at room temperature are shown in Table 5 together with the 0.75-hours-heating temperatures used in heating the steel bars having a diameter of 50 mm on the basis of the aforementioned categories <1> to <3>.

TABLE 5

| | Steel | Heating temp. (° C.) | Rotating bending fatigue strength: Medium cycle | | High cycle | |
|---|---|---|---|---|---|---|
| * | a | 1050 | $ | 100 | $ | 100 |
| | b | 1200 | | 125 | | 120 |
| | c | 1200 | | 115 | | 110 |
| * | d | 1200 | # | 105 | # | 105 |
| * | e | 1050 | # | 95 | # | 105 |
| | f | 1200 | | 120 | | 115 |
| * | g | 1050 | # | 100 | # | 105 |
| * | h | 1200 | | 110 | # | 100 |
| | i | 1200 | | 115 | | 110 |
| | j | 1200 | | 120 | | 115 |
| * | k | 1300 | # | 105 | # | 100 |
| * | l | 1300 | # | 105 | # | 100 |
| | m | 1200 | | 120 | | 115 |
| * | n | 1200 | # | 105 | # | 105 |
| | o | 1200 | | 115 | | 115 |
| | p | 1200 | | 120 | | 125 |
| | q | 1200 | | 120 | | 120 |
| | r | 1200 | | 120 | | 120 |
| | s | 1200 | | 115 | | 115 |
| * | t | 1300 | # | 100 | # | 100 |
| * | u | 1300 | # | 95 | # | 100 |
| | v | 1200 | | 110 | | 115 |
| * | w | 1200 | # | 105 | # | 100 |
| * | x | 1200 | # | 105 | # | 105 |
| | y | 1200 | | 120 | | 120 |
| * | z | 1300 | # | 100 | | 110 |
| | A | 1200 | | 125 | | 125 |
| | B | 1200 | | 130 | | 130 |
| | C | 1200 | | 135 | | 130 |
| | D | 1200 | | 125 | | 125 |
| | E | 1200 | | 140 | | 130 |
| | F | 1200 | | 115 | | 115 |
| * | G | 1050 | # | 105 | # | 105 |
| | H | 1200 | | 130 | | 125 |
| | I | 1200 | | 130 | | 130 |

The column of "Heating temp." denotes that the steel bar having a diameter of 50 mm was heated at the shown temperature for 0.75 hours.
The column of "Medium cycle" denotes the fatigue strength at $1.0 \times 10^4$ cycles.
The column of "High cycle" denotes the fatigue strength at $1.0 \times 10^7$ cycles.
The mark * denotes that the steel is falling outside the conditions regulated by the present invention.
The mark $ denotes the reference of evaluation.
The mark # denotes falling short of the target in the present invention.

As apparent from Tables 3 to 5, the steels satisfying the conditions regulated by the present invention can achieve the target of the effect of preventing the austenite grain coarsening, and the target bending fatigue strength (the medium cycle rotating bending fatigue strength and the high cycle rotating bending fatigue strength).

In contrast, the steels of the "comparative examples" falling outside the conditions regulated by the present invention cannot achieve one or both of the said targets, that is to say, target of the effect of preventing the austenite grain coarsening, and the target bending fatigue strength (the medium cycle rotating bending fatigue strength and the high cycle rotating bending fatigue strength).

INDUSTRIAL APPLICABILITY

The steel for carburizing or carbonitriding use in accordance with the present invention can stably prevent the austenite grain coarsening, when the said steel is heated in the process of carburizing or carbonitriding, especially when the steel is heated at a temperature of 980° C. or less for three hours or less even if being hot forged in various temperature ranges, especially being hot forged after being heated to 1050 to 1300° C., and in addition can ensure an excellent bending fatigue strength after carburizing or carbonitriding; accordingly, the steel according to the present invention can be suitably used as a steel for a starting material of parts, such as gears, pulleys, and shafts, that are roughly formed by hot forging.

The invention claimed is:

1. A steel for carburizing or carbonitriding use consisting of, by mass %;

C: 0.18 to 0.3%,
Si: 0.01 to 0.09%,
Mn: 0.6 to 1.5%,
S: 0.012 to 0.05%,
Cr: 0.5 to 2.0%,

Al: 0.030 to 0.050%,
Ti: 0.0006 to 0.0025%,
N: 0.010 to 0.025%, and
O: 0.0006 to 0.0012%, and
the balance of Fe and impurities, wherein P and Nb among the impurities are P: 0.025% or less and Nb: 0.003% or less respectively,
and further the following formulas (1) and (2) are satisfied:

$$-5.0 \leq \log(Ti \times N) \leq -4.4 \quad (1),$$

$$-12.5 \leq \log(Al^2 \times O^3) \leq -11.7 \quad (2),$$

wherein each element symbol in the above formulas (1) and (2) represents the content by mass percent of the element concerned.

2. A steel for carburizing or carbonitriding use consisting of, by mass %;
C: 0.18 to 0.3%,
Si: 0.01 to 0.09%,
Mn: 0.6 to 1.5%,
S: 0.012 to 0.05%,
Cr: 0.5 to 2.0%,
Al: 0.030 to 0.050%,
Ti: 0.0006 to 0.0025%,
N: 0.010 to 0.025%,
O: 0.0006 to 0.0012%, and
at least one element selected from Mo: 0.5% or less, Ni: 1.5% or less, and Cu: 0.4% or less, and
the balance of Fe and impurities, wherein P and Nb among the impurities are P: 0.025% or less and Nb: 0.003% or less respectively,
and further the following formulas (1) and (2) are satisfied:

$$-5.0 \leq \log(Ti \times N) \leq -4.4 \quad (1),$$

$$-12.5 \leq \log(Al^2 \times O^3) \leq -11.7 \quad (2),$$

wherein each element symbol in the above formulas (1) and (2) represents the content by mass percent of the element concerned.

3. The steel for carburizing or carbonitriding use according to claim 1, the steel has less than two austenite grains having a grain size number of 4 or less exist in the field of 10 $mm^2$, when the steel is heated at 1050 to 1300° C., hot forged, cooled down to room temperature, and heated at 980° C. or less for three hours or less.

4. The steel for carburizing or carbonitriding use according to claim 1, the steel has less than two austenite grains having a grain size number of 4 or less exist in the field of 10 $mm^2$, when the steel is heated at 1050 to 1300° C., hot forged, cooled down to room temperature, and heated at 980° C. or less for three hours or less.

* * * * *